US006723059B1

(12) United States Patent
Park

(10) Patent No.: US 6,723,059 B1
(45) Date of Patent: Apr. 20, 2004

(54) THERAPEUTIC BED WITH VIBRATING ELEMENT

(76) Inventor: Ki Dong Park, 6545 Grange St., Suite 103, Alexandria, VA (US) 22315

( * ) Notice: Subject to any disclaimer, the term of this patent is extended or adjusted under 35 U.S.C. 154(b) by 0 days.

(21) Appl. No.: 10/025,779

(22) Filed: Dec. 26, 2001

(51) Int. Cl.[7] ..... A61H 23/02

(52) U.S. Cl. ..... 601/60; 601/49; 601/70; 5/915

(58) Field of Search ..... 601/46–49, 51, 601/53–54, 61, 69–70, 84, 86–87, 89–93, 97–98, 101, 56, 57, 59, 60, 67

(56) References Cited

U.S. PATENT DOCUMENTS

| | | | | | |
|---|---|---|---|---|---|
| 1,797,306 | A | * | 3/1931 | Webb | 601/56 |
| 2,610,040 | A | * | 9/1952 | Emmons | 601/49 |
| 2,937,641 | A | * | 5/1960 | Oetinger | 601/59 |
| 2,980,108 | A | * | 4/1961 | Scott | 601/57 |
| 3,048,168 | A | * | 8/1962 | Kamp | 601/59 |
| 3,613,673 | A | * | 10/1971 | La Hue | 601/59 |
| 4,728,293 | A | * | 3/1988 | Kole, Jr. | 434/236 |
| 4,769,864 | A | * | 9/1988 | Park | 5/190 |
| 4,798,414 | A | * | 1/1989 | Hughes | 297/284.4 |
| 4,958,627 | A | * | 9/1990 | Park | 601/49 |
| 5,056,506 | A | * | 10/1991 | Verduci | 601/49 |
| 5,106,159 | A | * | 4/1992 | Iwamoto | 297/411.27 |
| 5,216,769 | A | * | 6/1993 | Eakin | 5/620 |
| 5,233,973 | A | * | 8/1993 | Gill et al. | 601/103 |
| 5,443,439 | A | * | 8/1995 | Ohshita | 601/90 |
| 6,076,893 | A | * | 6/2000 | Brotherston | 297/423.35 |
| 6,237,984 | B1 | * | 5/2001 | Cross | 296/97.4 |

* cited by examiner

*Primary Examiner*—Nicholas D. Lucchesi
*Assistant Examiner*—Victor Hwang

(57) ABSTRACT

A therapeutic bed mattress. In one embodiment, the bed mattress includes a mattress frame (1A), rope elements (26) are secured substantially to an upper surface of the bed frame. The rope elements are secured between at least two sides of the bed frame. At least one vibration member (16) is attached to and below the rope elements. The vibration member includes a shaft (12), a pulley (13) attached axially to one end of the shaft, and a counterweight (11) attached to the shaft. At least one motor (10) including an output shaft (12) and a motor pulley (14) axially attached to the output shaft vibrates the rope elements. At least one belt (9) is secured between the pulley of the vibration member and the motor pulley of the motor, such that when the motor is powered, the output shaft of the motor rotates the motor pulley which rotates the belt such that the pulley of the vibration member is rotated to rotate the shaft of the vibration member and the counterweight, in order to vibrate the rope elements. In another embodiment, the vibration member (16) is replaced by a vibrator (23). In yet another embodiment, the bed mattress is a recliner.

6 Claims, 7 Drawing Sheets

THERAPEUTIC BED WITH VIBRATING ELEMENT

BACKGROUND OF THE INVENTION

1. Field of the Invention

The present invention relates to a therapeutic bed and more particularly, to a bed with one or more vibrating member(s) that provide massaging function to a user.

2. Description of the Related Art

Therapeutic bed are well known in the art which use air bags or water containers. However, since air and/or water is displaced when pressure due to the weight of the user is applied on such mattresses, the pressure force is generally not concentrated at the desired regions of the body such as joints, bones, or muscles of a human body that require therapeutic massaging to relieve stress.

U.S. Pat. No. 4,769,864 issued to the present inventor discloses a therapeutic bed including a plurality of parallel wires for defining a bed floor.

U.S. Pat. No. 4,958,627 also issued to the present inventor discloses an improved therapeutic bed including a plurality of parallel rubber wires placed on a bed frame, and a vibrating motor and an intermittent hitting plate operatively associated with the rubber wires for massaging the human body.

SUMMARY OF THE INVENTION

Accordingly, it is an object of the present invention to provide an improved therapeutic bed for massaging specific regions of the human body, which eliminates the above problems encountered with conventional therapeutic beds.

Another object of the present invention is to provide an improved therapeutic bed with rope elements secured to an upper surface of the bed frame, with one or more vibrating members attached to the rope elements to more effectively vibrate desired portions of the user's body.

Yet another object of the present invention is to provide a therapeutic bed in which the vibrating members is part of a system in which the vibrating members are connected to the central motor via belts and pulleys.

A further object of the present invention is to provide a therapeutic bed in which vibrating members are individually powered, each including an individual motor and vibration elements.

A further object of the present invention is to provide a therapeutic bed in which the therapeutic bed is in the form of a chair in which vibrating members are individually powered, each including an individual motor and vibration elements.

Other objects and further scope of applicability of the present invention will become apparent from the detailed description given hereinafter. It should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given below and the accompanying drawings are given by way of illustration only and thus are not limitative of the present invention, and wherein.

DETAILED DESCRIPTION OF THE PREFERRED EMBODIMENTS

For the purpose of illustrating the preferred embodiments of present invention, the drawings will be described in great detail.

Figure 1:
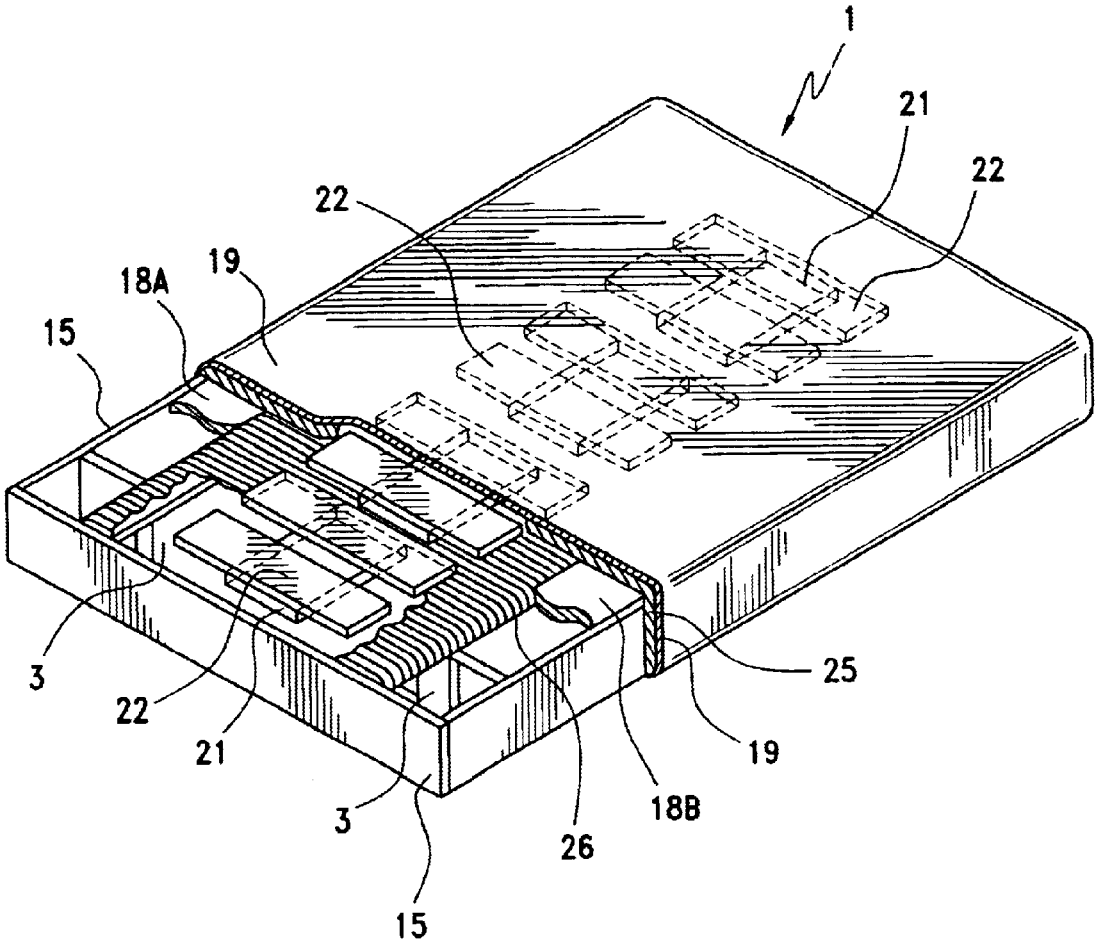
FIG. 1 is a perspective view of a therapeutic bed showing a cutaway portion of the bed according to one embodiment of the present invention.

FIG. 1 illustrates a perspective view of a therapeutic bed showing a cutaway portion of the bed according to one embodiment of the present invention. The therapeutic bed can be in form of a mattress in which rigid supports in the form of outer frame 15, vertical supports 3 support a rope pad formed of rope elements 26. In addition, longitudinal boards 21 and transverse boards 22 are shown overlapping each other and positioned above the rope elements 26, in order to support the vibration members 16 (shown in FIGS. 2 and 3). The upper left and right boards 18A, 18B are positioned in the space between the rope pad and the outer frame 15, above the vertical supports 3 to provide upper surface support for the therapeutic bed. A foam cushion pad 25 is preferably positioned to cover the rope pad made of the rope elements 26 and the upper left and right boards 18A, 18B, and outer surfaces of the outer frame 15. An outer cover 19 provides some protection for the foam cushion pad 25.

Figure 2:
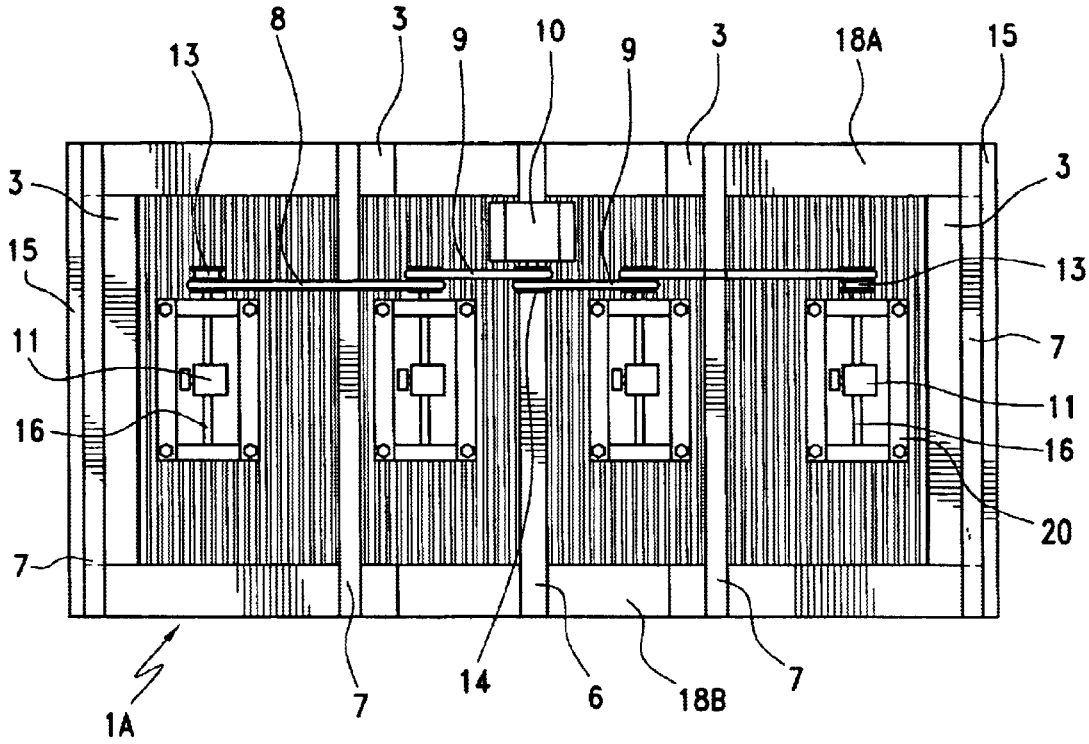
FIG. 2 is a bottom view of certain components of the therapeutic bed shown in FIG. 1.
Figure 3:
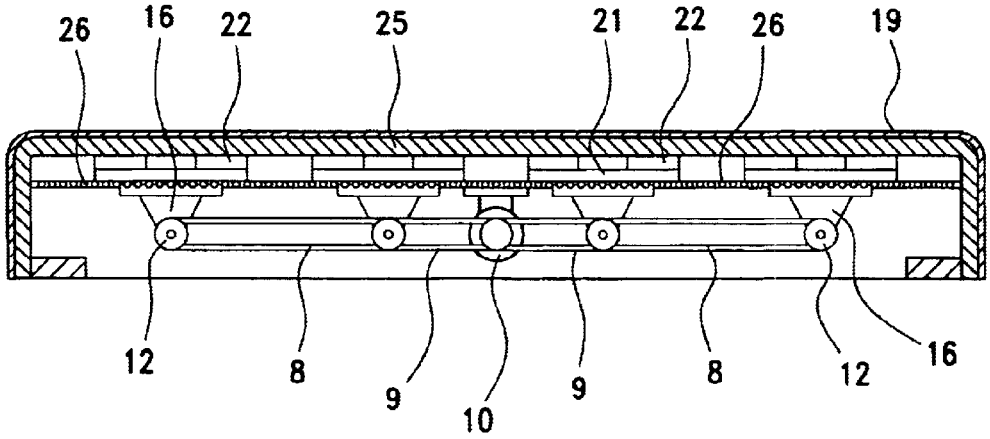
FIG. 3 is an sectional view taken along lines 3—3 of FIG. 2.
Figure 4:
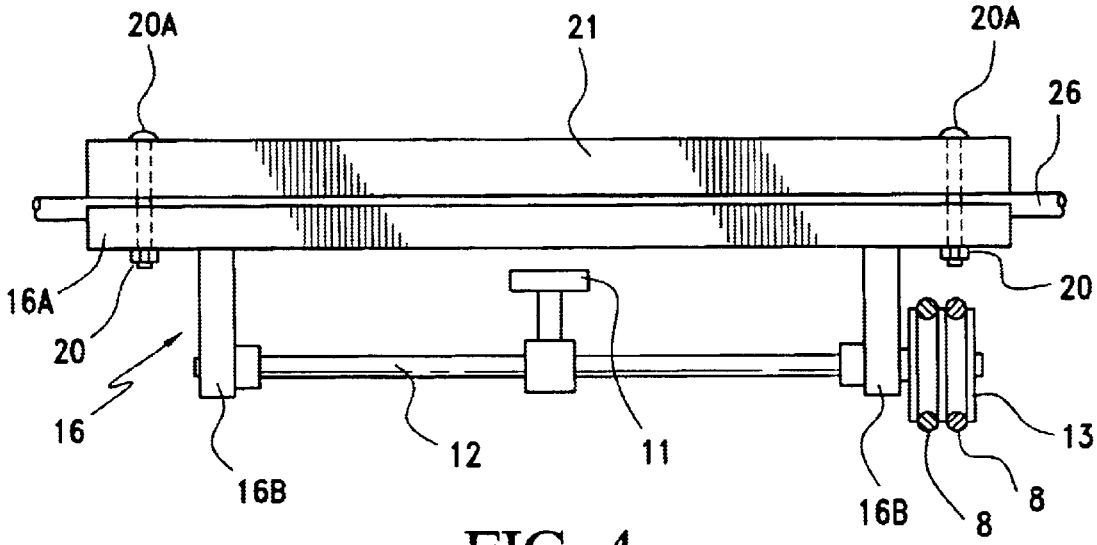
FIG. 4 is a front view of a vibrating member of the therapeutic bed shown in FIG. 2.
Figure 5:
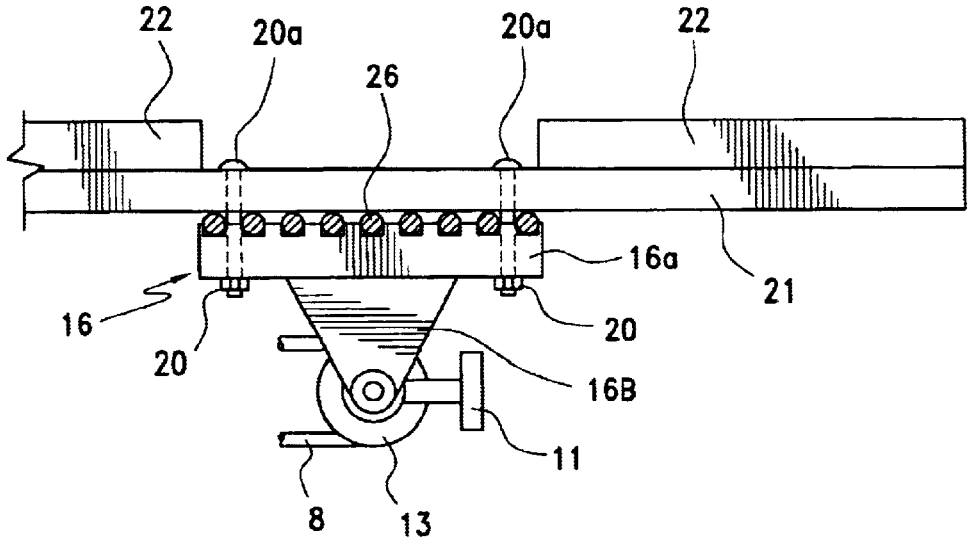
FIG. 5 is a side view of the vibrating member connected to the rope elements of the therapeutic bed shown in FIG. 1.
Figure 8:
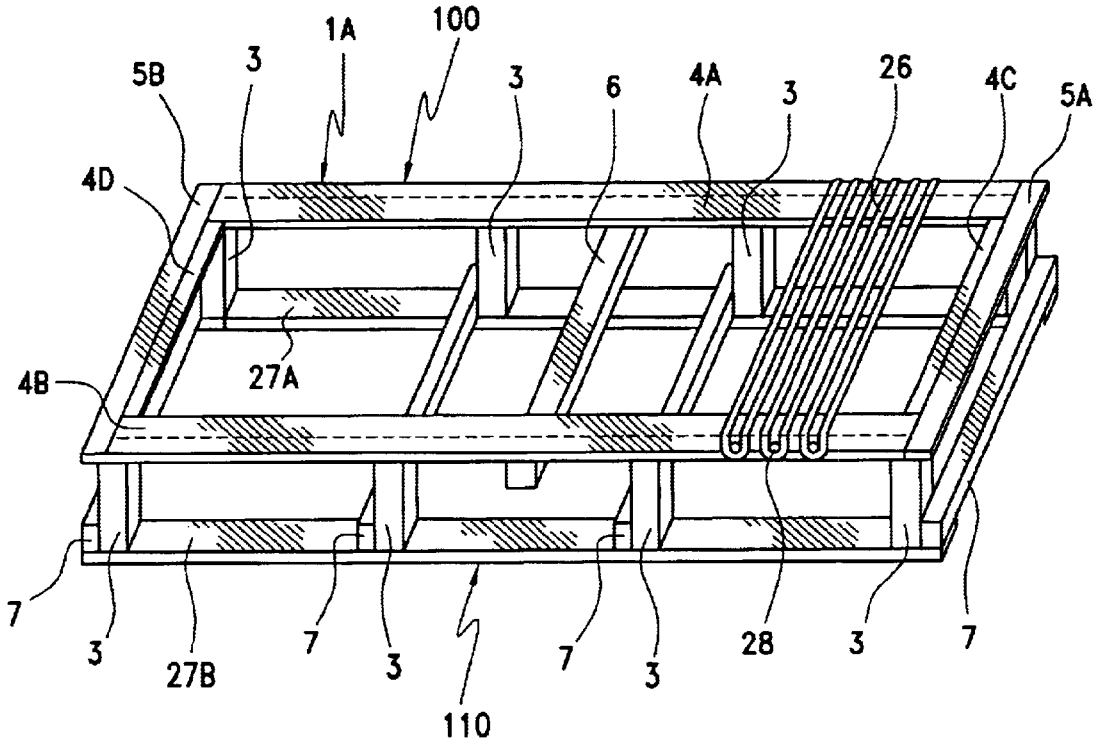
FIG. 8 is perspective view of the bed frame of the therapeutic bed.

FIGS. 2–5 illustrate how the vibration members are secured to the rope elements 26. A motor 10 is secured to a middle transverse support beam 6 that is secured to the bed frame 1A, as shown in FIG. 8. The rope elements 26 are secured to an upper surface of the bed frame 1A. The rope elements 26 are secured substantially between at least two sides of the bed frame 1A. A series of vibration members 16 attached to and below the rope elements 26, while being spaced apart. The vibration members each includes a shaft 12, a pulley 13 attached axially to one end of the shaft 12, and a counterweight 11 attached to the shaft (as illustrated in FIGS. 4 and 5). Preferably the single motor 10 includes an output shaft 12 and a motor pulley 14 axially attached to the output shaft 12, and at least one belt 9 is secured between the pulleys 13 of the vibration members 16 and the motor pulley 14 of the motor 10, such that when the motor 10 is powered, the output shaft (not illustrated) of the motor 10 rotates the motor pulley which rotates the one or more belts 9 attached between the motor pulley 14 and adjacent pulleys 13 such that the pulleys 13 of the vibration members 16 are rotated, which rotate the shafts of the vibration member 16 and the respective counterweights 11, in order to vibrate the rope elements 26.

As shown in FIGS. 2 and 3, the motor pulley 14 and the pulleys 13 of the vibration members 16 are each configured to rotate at least two belts 8, 9. The pulleys 13, 14 are configured to rotate two belts 8, 9, such that when the motor pulley 14 is rotated, all of the belts 8,9 are rotated, causing vibration to the rope elements in the vicinity of the vibration members 16. The vibration members 16 are spaced longitudinally along the length of the bed frame 1A, with belts 9 attached to adjacent pulleys 13 of adjacent vibration members 16 such that when the motor is actuated, all of the vibration members 16 are vibrated in unison.

Figure 6:
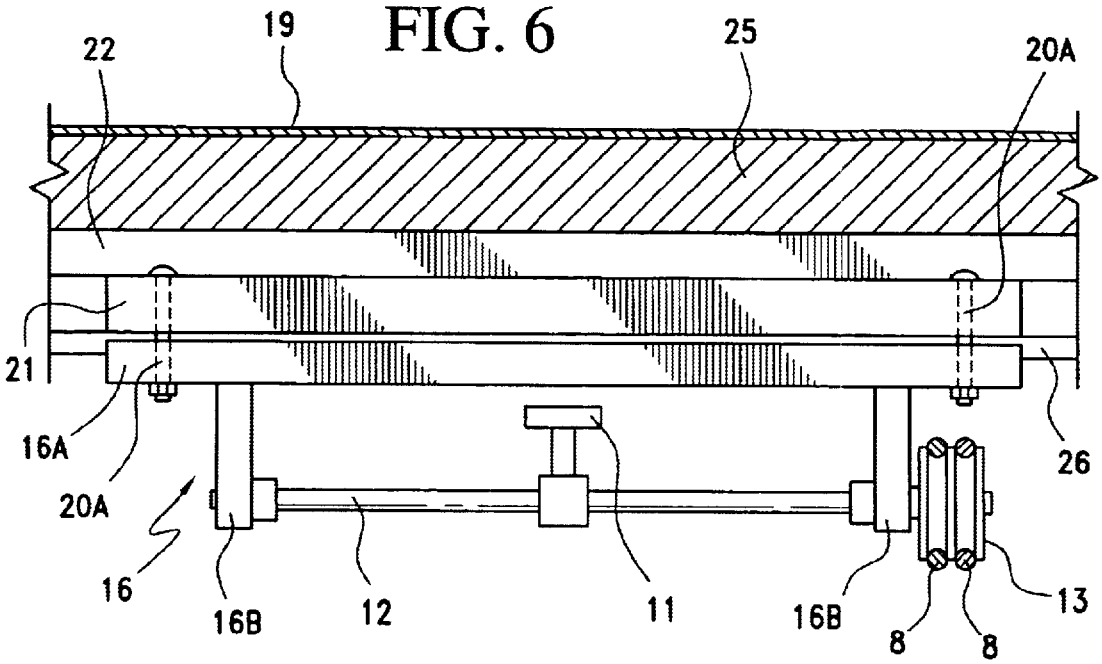
FIG. 6 is a front view of a vibrating member of the therapeutic bed shown in FIG. 2, shown with a sectional view of the foam cushion 25.

As shown in FIGS. 4 and 5, the vibration members 16 each includes an upper plate 16A, a pair of shaft support members 16B extending from the upper plate 16A such that the shaft 12 is rotatively housed between the shaft support members. FIG. 6 is a view similar to FIG. 4, with a sectional view of the foam cushion 25.

FIGS. 2 and 8 show additional transverse support beams 7 transversely secured between the vertical supports 3, in order to provide a rigid structure for the bed frame 1A.

FIGS. 3–5 illustrate the longitudinal supporting boards 21 resting directly on the rope elements 26, with the upper plate 16A of the vibration member 16 positioned below the rope elements 26, and an attaching device in the form of screws 20A and nuts 20 that secure each of the vibration members 16 to the respective longitudinal supporting board 21. A pair of transverse supporting boards 22 are attached to an upper surface of each of the longitudinal supporting boards 21, between left and right sides of the bed frame 1A. The therapeutic bed 1 includes vibration members 16 secured longitudinally along the length of the bed frame.

As shown in FIG. 8, the bed frame includes an upper frame 100, a lower frame 110 and the vertical supports 3 secured between the upper frame 100 and the lower frame 110, with the rope elements 26 that are secured 28 to the upper frame 100. The upper frame 100 consists of left and right upper boards 4A, 4B, and transverse upper boards 4C, 4D, and upper transverse boards 5A, 5B secured on the respective transverse upper boards 4C, 4D and left and right upper boards 4A, 4B. The lower frame consists of left and right lower boards 27A, 27B and transverse support beams 7 that are secured between the left and right lower boards 27A, 27B. Vertical supports 3 support the upper frame 100 to the lower frame 110. Preferably the upper frame 100 and the lower frame 110 are rectangular in shape.

Figure 7:
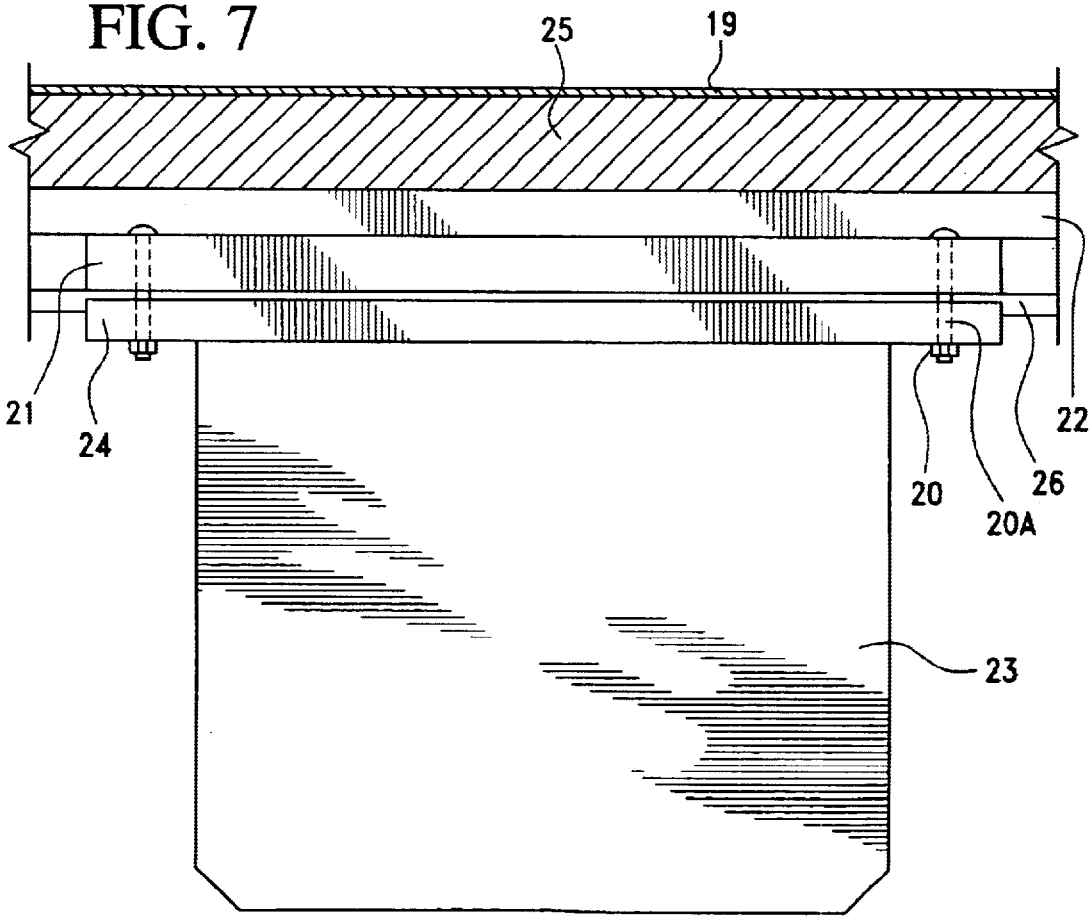
FIG. 7 is a view similar to FIG. 6 in which the individual vibration members having independent power units are shown attached to the rope elements.
Figure 9:
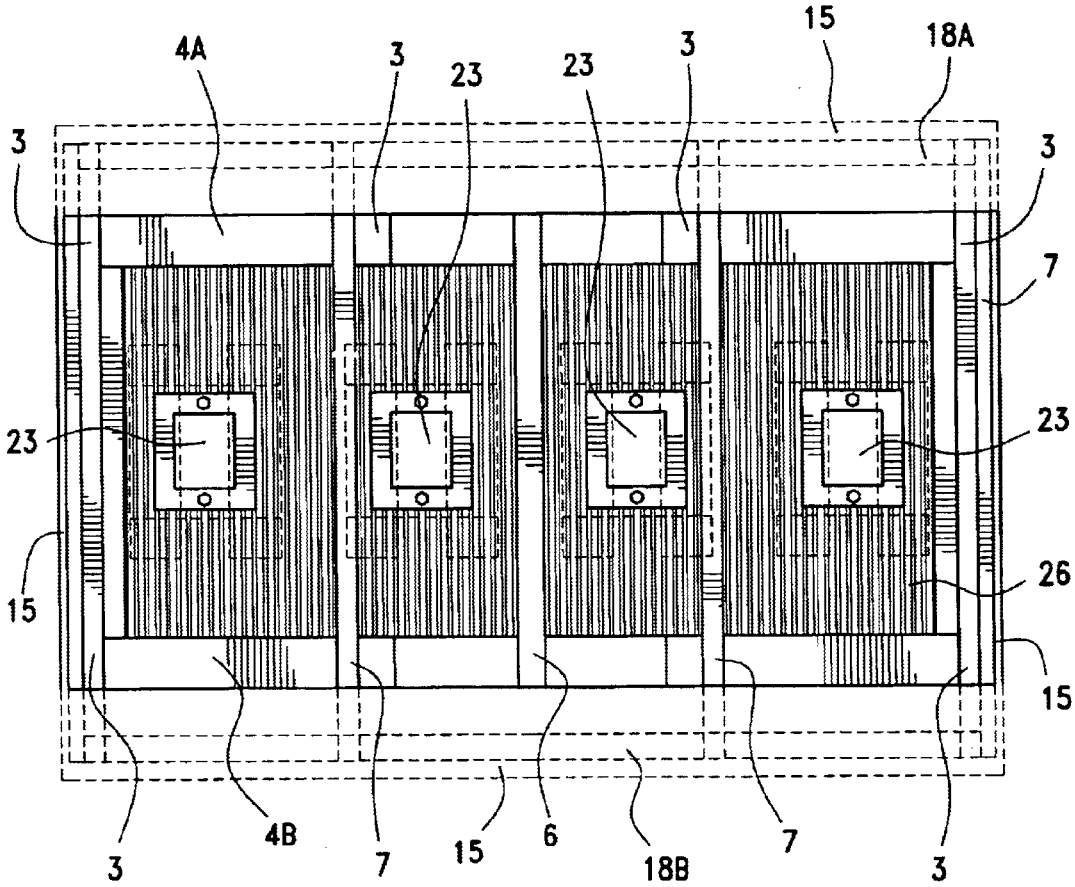
FIG. 9 is a view similar to FIG. 2, showing a bottom view of certain components of the therapeutic bed shown in which individually powered vibration members are shown secured to the rope elements.
Figure 10:
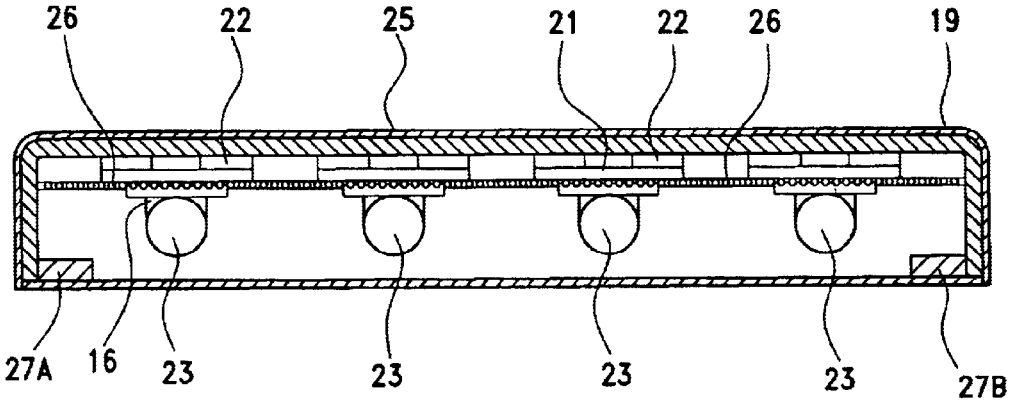
FIG. 10 is a view similar to FIG. 3, showing the individually powered vibration members secured to the rope elements.

FIGS. 7, 9 and 10 illustrate alternative vibration members in the form of vibrators 23 that are secured to the rope elements 26 in the manner previously discussed. The vibrators 23 are individually powered and each vibrator 23 houses a motor (not illustrated) and vibration elements (not illustrated) in a manner that is well known to those skilled in the art. Vibrators, such as Model No. 28 of the Frederick Manufacturing Co., Inc. of Racine Wis., and similar models can be used as the vibrators 23 of the invention. The vibrators 23 are attached to and below the rope elements 26. The bases 24 of the vibrators 23 are secured to respective longitudinal supporting boards 21 via nuts 20 and screws 20A, in the same manner as previously discussed. When the motors of the vibrators 23 is powered, the motor vibrates the vibrators 23 in order to vibrate the rope elements. In this embodiment, the power and regularity of the individual vibrators 23 can be controlled by a central processing unit (not illustrated) to provide a variety of massaging sequences that are customized to the needs of a particular user.

Figure 11:
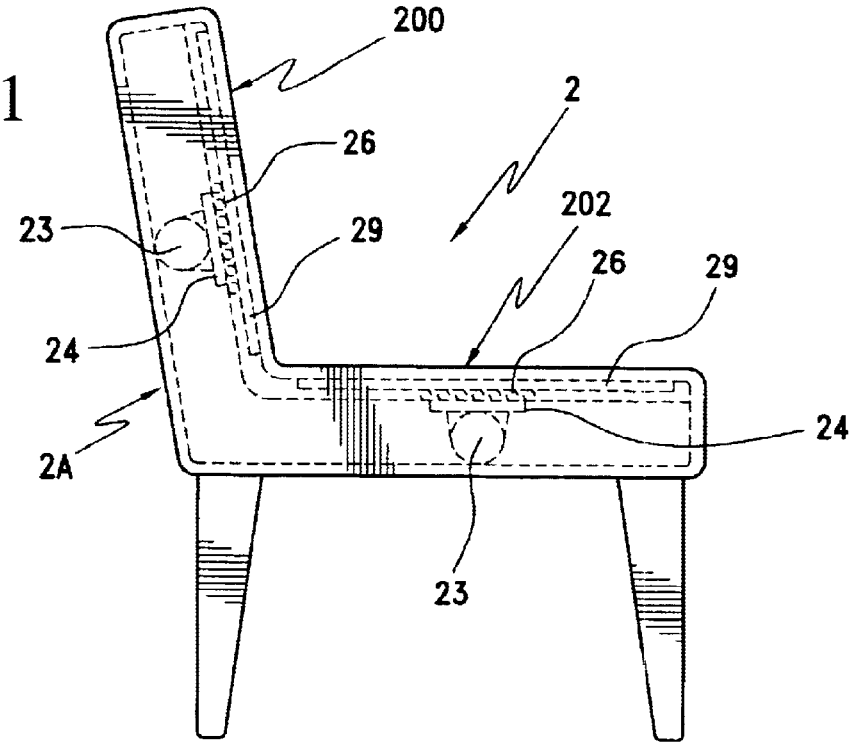
FIG. 11 is a side view of the therapeutic bed in the form of a therapeutic chair in which individually powered vibration members are shown secured to the rope elements along the seating surfaces of the chair.
Figure 12:
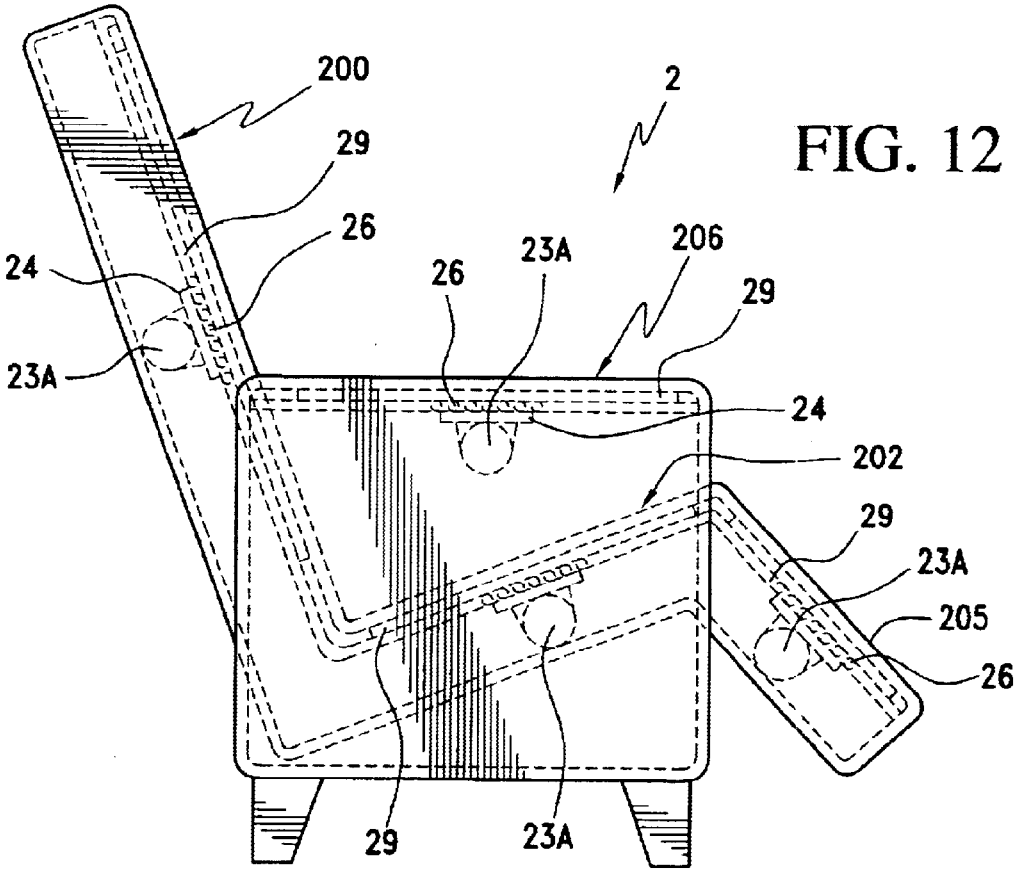
FIG. 12 is a side view of the therapeutic bed in the form of a reclined therapeutic chair in which individually powered vibration members are shown secured to the rope elements along the seating surfaces of the chair.

FIGS. 11 and 12 illustrate side views of the therapeutic bed in the form of a therapeutic chair 2 in which individually powered vibrators 23 are shown secured to respective rope elements 26 behind respective seating surfaces and in arm rests of the chair 2. The chair frame 2A of the chair 2, includes a back support 200 and a seat 202. Rope elements 26 are secured to an upper surface of the chair frame 2A, and the rope elements 26 are secured between at least two sides of the chair frame 2A. Supporting boards 29 are positioned on upper surfaces of the rope elements 26. Vibrators 23 each include at least one motor (not illustrated) and vibration elements (not illustrated) housed within the vibrators 23. The vibrators 23 are secured behind the back support 200 and the seat 202. The therapeutic bed in the form of a chair 2 can be in the form of a reclining chair with a leg rest 205 and side arm rests 206. Vibrators 23A are also attached to the arm rests 206 and the leg rests 205, in the manner described previously.

Overall, the vibration members 16 and vibrators 23 can be located in locations below the rope pad consisting of the rope elements 26 for which desired massaging functions are desired fro the user. The use of individually powered vibrators is advantageous in that they can be located anywhere below the rope elements, to be greatly customized for the maximum comfort or requirements of the user.

The present invention is by no means restricted to the above-described preferred embodiments, but covers all variations that might be implemented by using equivalent functional elements or devices that would be apparent to a person skilled in the art, or modifications that fall within the spirit and scope of the appended claims.

I claim:

1. A therapeutic bed (1) comprising:

a bed frame (1A);

a plurality of rope elements (26) secured to an upper surface of the bed frame, the rope elements secured substantially between at least two sides of the bed frame;

at least one vibration member (16) attached to and below the rope elements, the vibration member (16) comprising a shaft (12);

a pulley (13) attached axially to one end of the shaft;

a counterweight (11) attached to the shaft;

at least one motor (10), the motor comprising an output shaft (12) and a motor pulley (14) axially attached to the output shaft;

at least one belt (9) secured between the pulley of the vibration member and the motor pulley of the motor, such that when the motor is powered, the output shaft of the motor rotates the motor pulley which rotates the belt such that the pulley of the vibration member is rotated to rotate the shaft of the vibration member and the counterweight, in order to vibrate the rope elements;

wherein the vibration member comprises an upper plate (16A), and a pair of shaft support members (16B) extending from the upper plate such that the shaft is rotatively housed between the shaft support members; and a longitudinal supporting board (21) resting directly on the rope elements, the upper plate of the vibration member positioned below the rope elements, and an attaching device (20) that secures the vibration member to the longitudinal supporting board, with the rope elements secured between the longitudinal supporting board and the vibrational member.

2. The therapeutic bed as claimed in claim 1, further comprising a transverse supporting board (22) attached to an upper surface of the longitudinal supporting board, between left and right sides of the bed frame.

3. The therapeutic bed as claimed in claim 1, comprising a plurality of vibration members secured longitudinally along the length of the bed frame.

4. The therapeutic bed as claimed in claim 1, wherein the bed frame comprises an upper frame (100), a lower frame (110) and vertical supports (3) secured therebetween, and wherein the rope elements are secured to the upper frame.

5. The therapeutic bed as claimed in claim 4, wherein the bed frame further comprises transverse support beams (7) that are attached to the lower frame extending between the left and right sides thereof.

6. The therapeutic bed as claimed in claim 1, further comprising a cushion pad (25) positioned over the rope elements.

* * * * *